US011357094B2

(12) United States Patent
Miyazoe et al.

(10) Patent No.: US 11,357,094 B2
(45) Date of Patent: Jun. 7, 2022

(54) DEFLECTION ELECTROMAGNET DEVICE

(71) Applicant: HITACHI, LTD., Tokyo (JP)

(72) Inventors: Akihisa Miyazoe, Tokyo (JP); Yukihiro Murata, Tokyo (JP)

(73) Assignee: HITACHI, LTD., Tokyo (JP)

( * ) Notice: Subject to any disclaimer, the term of this patent is extended or adjusted under 35 U.S.C. 154(b) by 672 days.

(21) Appl. No.: 16/340,695

(22) PCT Filed: Jan. 22, 2018

(86) PCT No.: PCT/JP2018/001726
§ 371 (c)(1),
(2) Date: Apr. 10, 2019

(87) PCT Pub. No.: WO2018/168199
PCT Pub. Date: Sep. 20, 2018

(65) Prior Publication Data

US 2019/0313521 A1 Oct. 10, 2019

(30) Foreign Application Priority Data

Mar. 13, 2017 (JP) ..... JP2017-047103

(51) Int. Cl.
*H05H 7/04* (2006.01)
*G21K 1/093* (2006.01)
(Continued)

(52) U.S. Cl.
CPC ..... *H05H 7/04* (2013.01); *G21K 1/093* (2013.01); *H01F 6/04* (2013.01); *H01F 7/20* (2013.01);
(Continued)

(58) Field of Classification Search
CPC ..... H05H 7/04; H05H 2007/04; H05H 13/04; G21K 1/093; H01F 6/00; H01F 6/04; H01F 6/06; H01F 7/20; H01F 7/202
See application file for complete search history.

(56) References Cited

U.S. PATENT DOCUMENTS 4,977,384 A 12/1990 Tatchyn et al.
5,010,640 A 4/1991 Gottschalk
(Continued)

FOREIGN PATENT DOCUMENTS

JP 06-050337 A 2/1994
JP 10-228500 A 8/1998
(Continued)

OTHER PUBLICATIONS

International Search Report of PCT/JP2018/001726 dated Mar. 27, 2018.

*Primary Examiner* — Ramon M Barrera
(74) *Attorney, Agent, or Firm* — Mattingly & Malur, PC

(57) ABSTRACT

A deflection electromagnet device generates a high magnetic field without increasing the size of a vacuum duct to facilitate control over a beam orbit. Magnetic flux lines from a return pole pass through the vacuum duct of a high-temperature superconductor in a vacuum heat insulation container and the charged particle beam is thus deflected, thereby generating radiation. A three-pole magnetic field is formed on the beam orbit and the charged particle beam is thus deflected by individual magnetic fields, so that radiation can be generated while the charged particle beam returns to a coaxial orbit. Therefore, an increase in size of the vacuum duct can be prevented. A shielding current is dominant and the non-uniformity of the magnetic field in a z-axis direction is prevented by disposing the high-temperature supercon-
(Continued)

ductor having a crystal direction c-axis orthogonal to a horizontal plane in which the charged particle beam flows.

14 Claims, 6 Drawing Sheets

(51) Int. Cl.
*H01F 6/04* (2006.01)
*H01F 7/20* (2006.01)
*H05H 13/04* (2006.01)

(52) U.S. Cl.
CPC ..... *H05H 13/04* (2013.01); *H05H 2007/046* (2013.01)

(56) References Cited

U.S. PATENT DOCUMENTS

| | | | | |
|---|---|---|---|---|
| 5,410,558 | A | 4/1995 | Hackett | |
| 2015/0340140 | A1* | 11/2015 | Yoshida | H01F 6/00 505/211 |

FOREIGN PATENT DOCUMENTS

| | | | |
|---|---|---|---|
| JP | 2006-22850 | A | 8/2006 |
| JP | 5158799 | B2 | 3/2013 |

* cited by examiner

[FIG. 1]
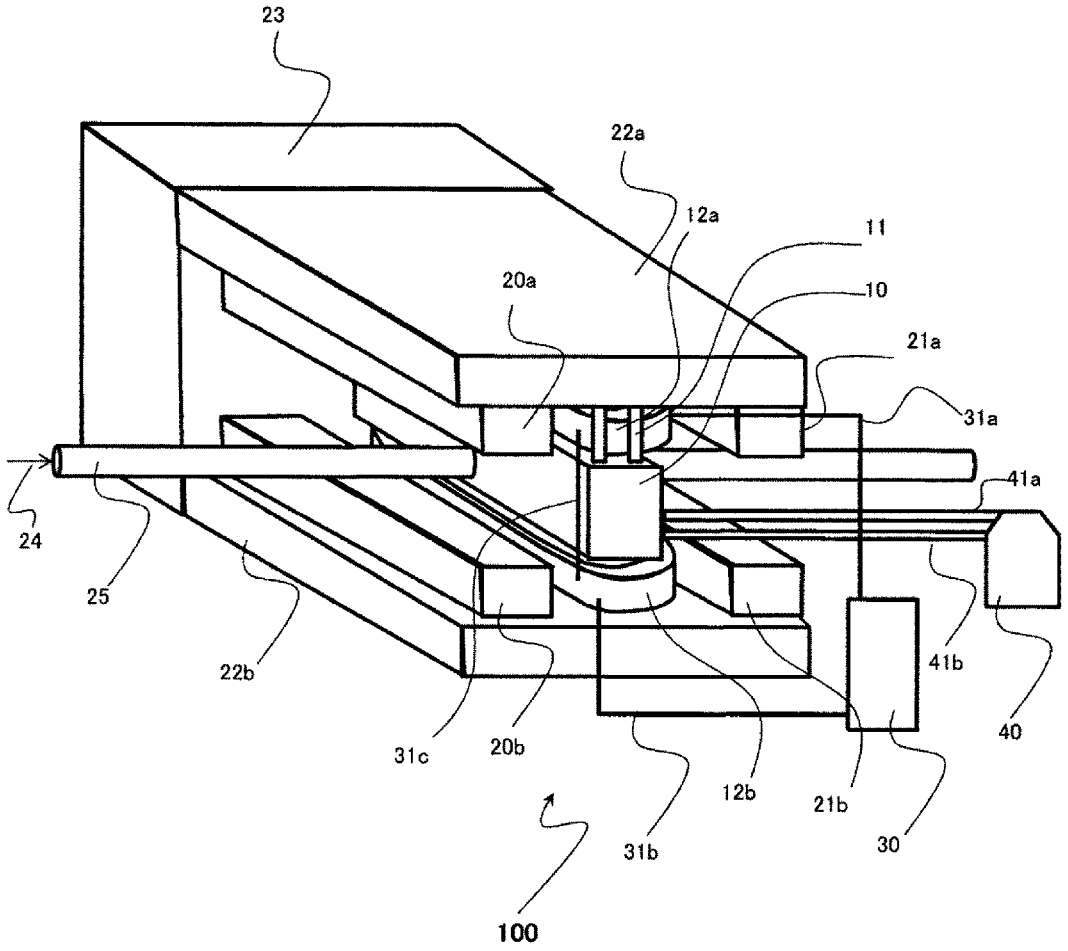

[FIG. 2]
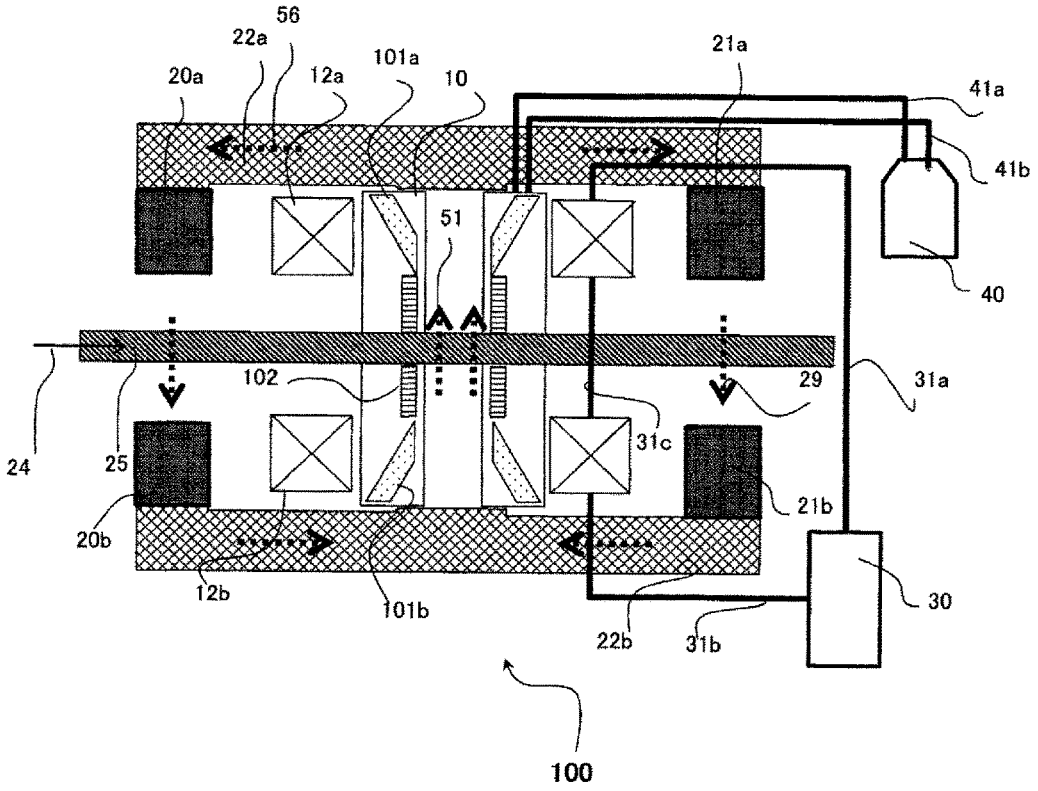
[FIG. 3]
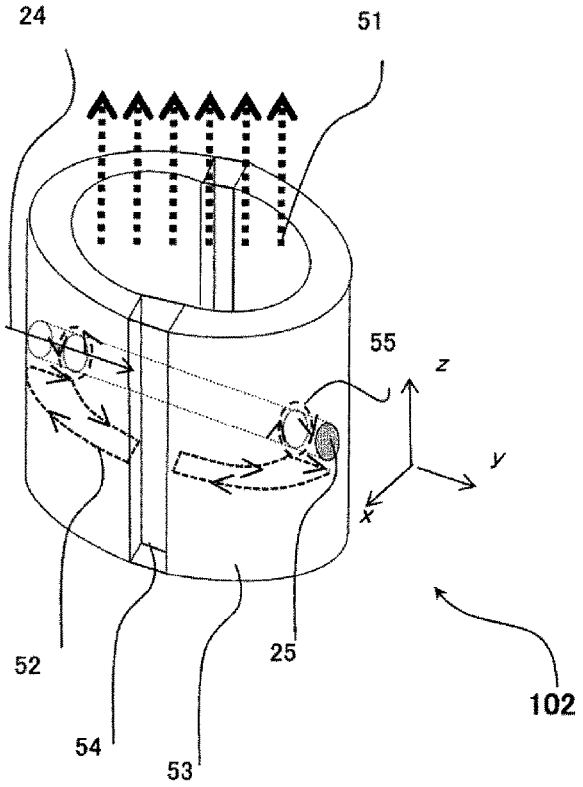

[FIG. 4]
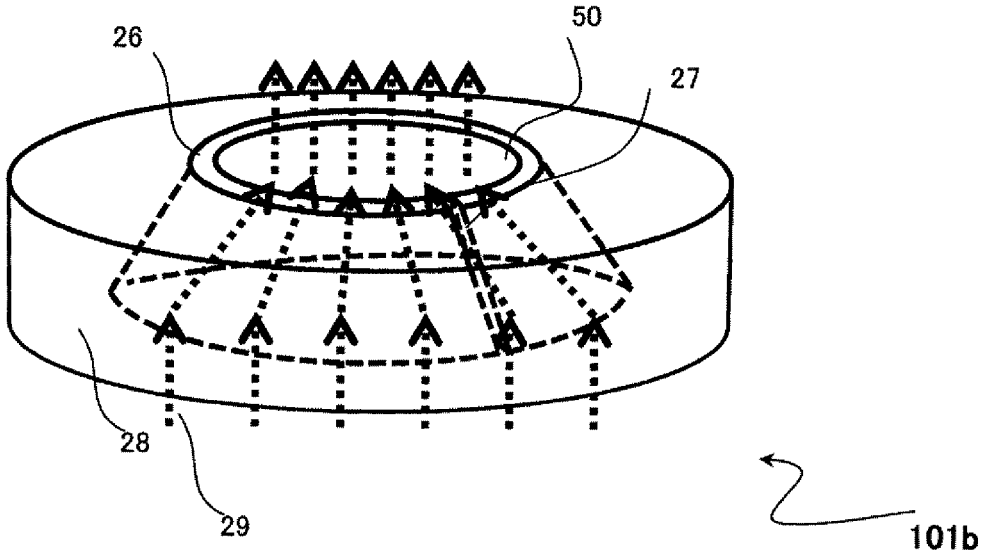
[FIG. 5]
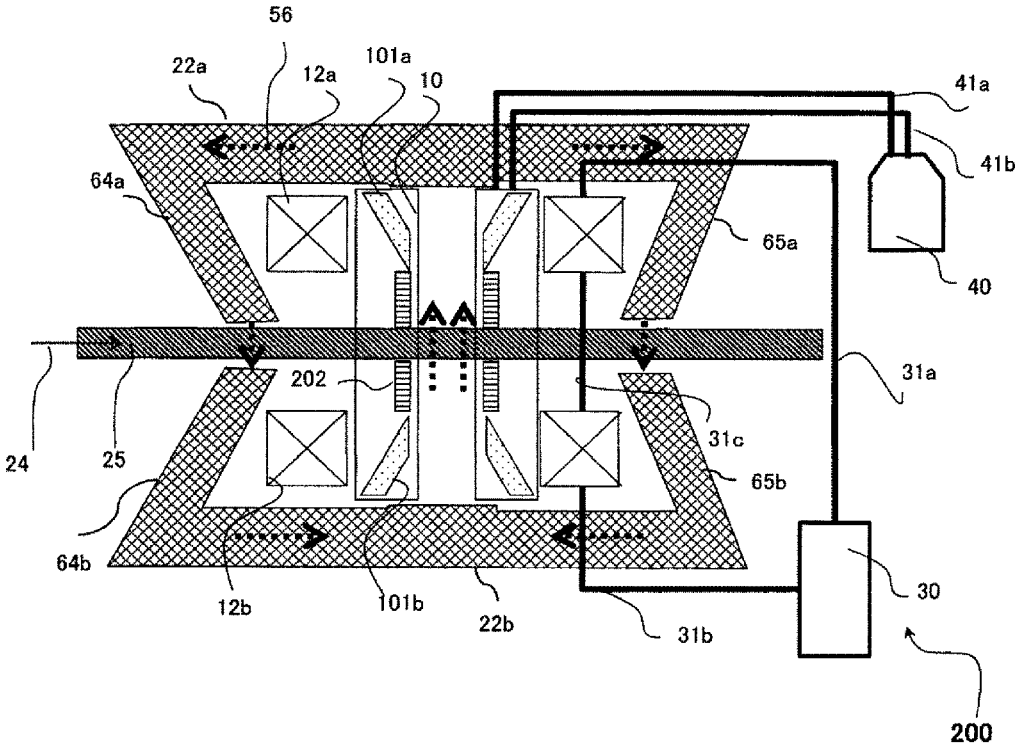

[FIG. 6]
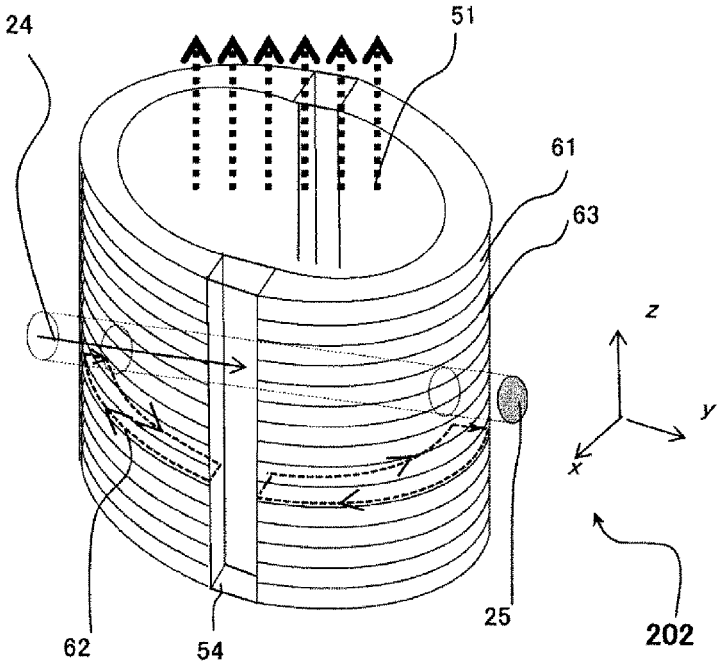
[FIG. 7]
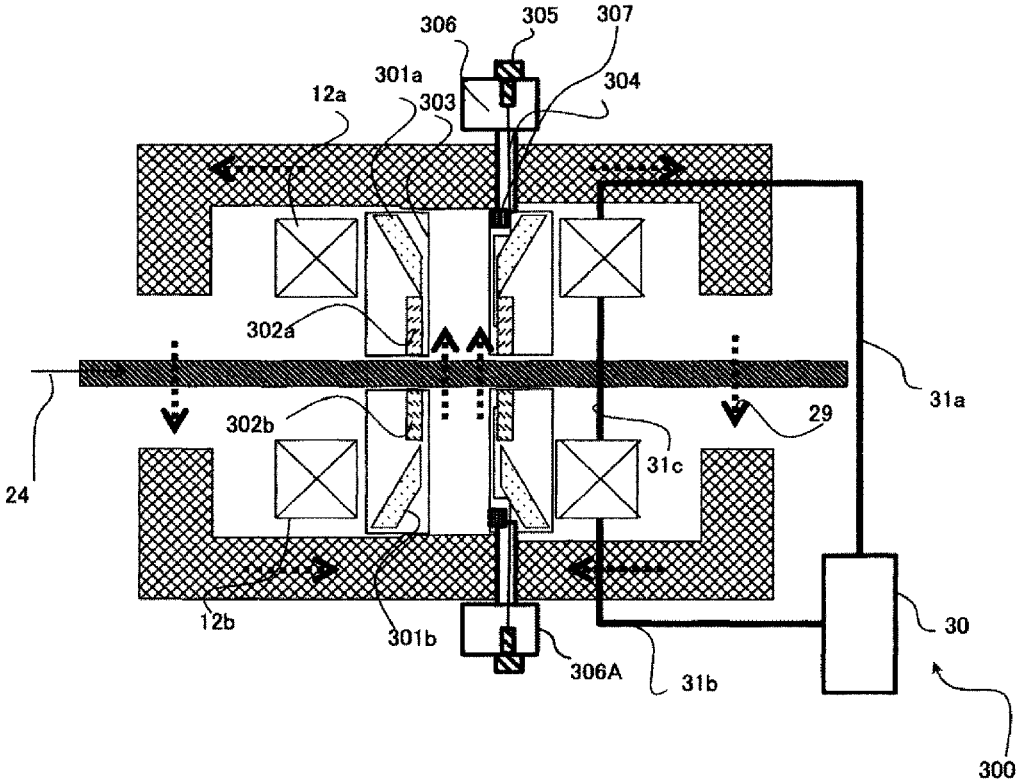

[FIG. 8]
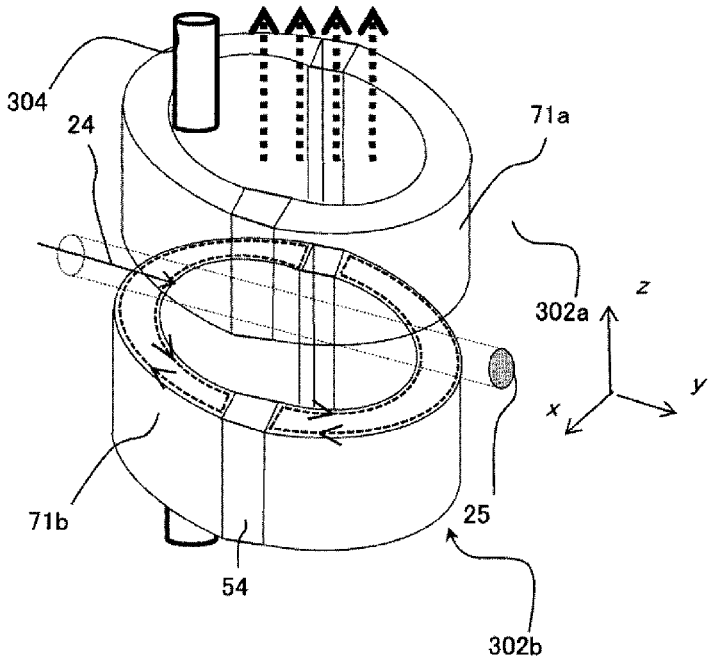
[FIG. 9]
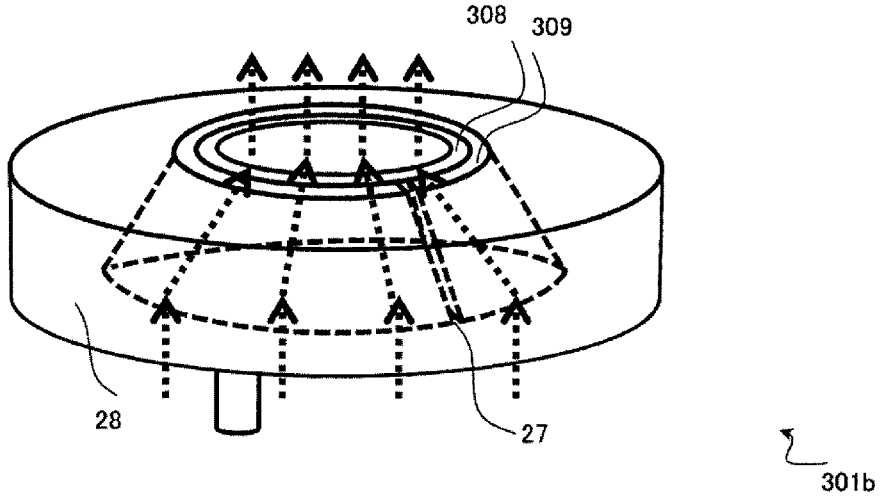

[FIG. 10]
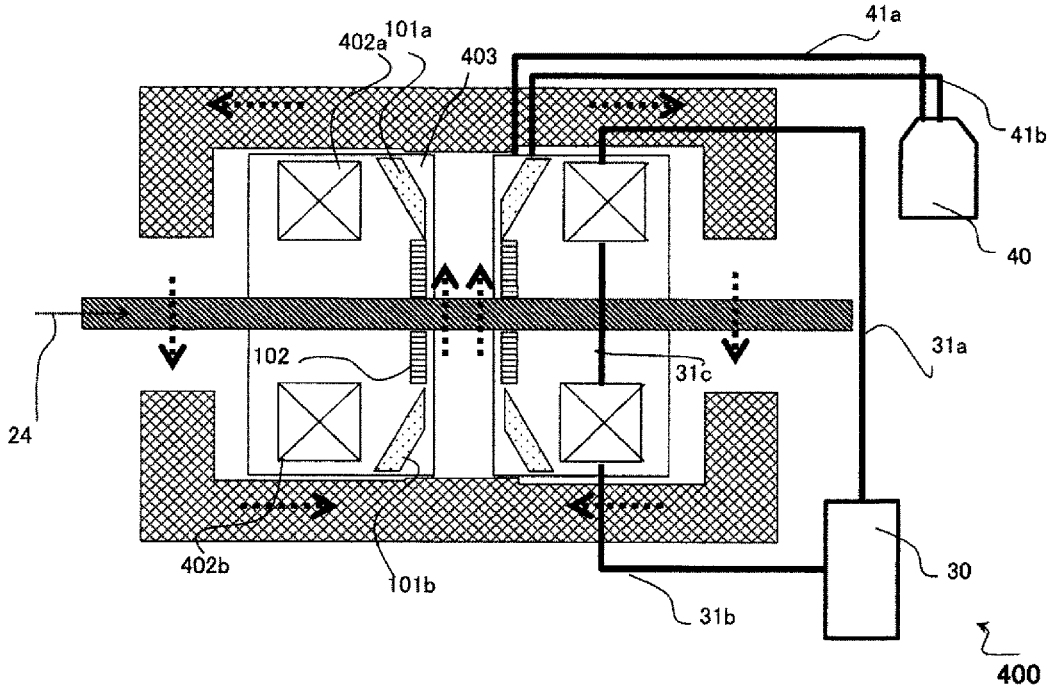
[FIG. 11]
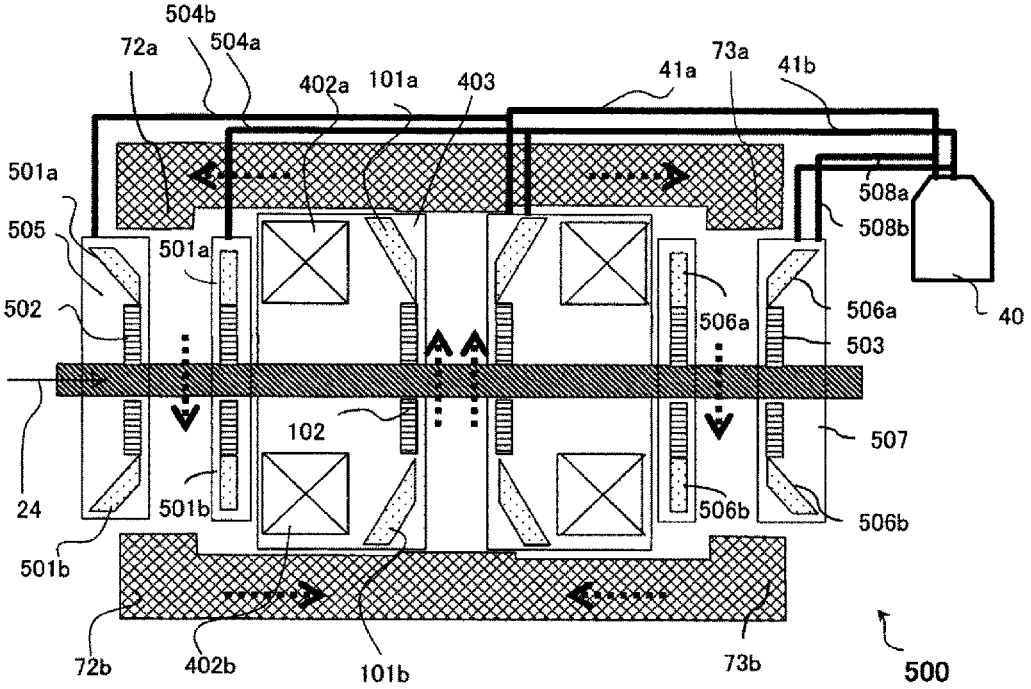

DEFLECTION ELECTROMAGNET DEVICE

TECHNICAL FIELD

The present invention relates to a deflection electromagnet device.

BACKGROUND ART

There is a technique of generating radiation by applying a magnetic field to a charged particle beam, such as an electron beam or a positron beam, to deflect a traveling direction of the beam. The generated radiation is used to obtain information about an atom of a substance, a sequence of a molecule, an electron state, a chemical reaction mechanism, and the like.

In order to generate radiation with a short wavelength, a high magnetic field needs to be generated, and there is a device called "wiggler" as a typical device. In the wiggler, in order to make the deflected beam return to a coaxial orbit, an integral value of magnetic field distribution on the beam orbit needs to be zero, and magnetic poles which generate magnetic fields having different polarities are arranged side by side. In order to obtain radiation with a shorter wavelength, higher magnetic field strength is needed, and there is a three-pole type superconducting wiggler which forms a magnetic circuit using a superconducting coil and a magnetic material.

PTL 1 describes a three-pole type wiggler, in which a central magnet using a superconducting coil, and side magnets having the central magnet interposed therebetween and provided on an incidence side and an emission side of an electron beam, are disposed to face each other with an electron beam path interposed therebetween. The three-pole type wiggler is a superconducting wiggler magnet configuration in which a permanent magnet and an electromagnet are combined, instead of a superconducting coil, for the side magnets.

PTL 2 discloses a technique of generating a high magnetic field by disposing a cylindrical or hollow conical superconductor having a wide inlet and a narrow outlet in an air core of a superconducting coil of a magnetic flux concentration device, and passing the generated magnetic flux of a superconducting magnet through the hollow part and concentrating the same.

PRIOR ART LITERATURE

Patent Literature

PTL 1: JP-A-H10-172800
PTL 2: Japanese Patent No. 5158799

SUMMARY OF INVENTION

Technical Problem

However, as described in PTL 1, when the generated magnetic field of the superconducting coil is to be enhanced, the coil is made large and the magnetic field is widely distributed along the orbit of the charged particle beam. Meanwhile, when the radiation is not emitted, the superconducting coil is not energized, and the charged particle beam passes through the orbit without being deflected. Therefore, a vacuum duct through which the charged particle beam passes is required to be configured in consideration of the presence or absence of the deflection of the charged particle beam, resulting in an increase in size.

Meanwhile, PTL 2 discloses a technique of generating a high magnetic field in a small space by using magnetic-flux induction materials which concentrates the magnetic flux using a superconductor.

However, when a hole inducing the charged particle beam in the space is provided in the magnetic flux induction materials, an induced current is generated around the hole of the magnetic flux induction materials so as to prevent leakage of the concentrated magnetic flux from the hole. As a result, the uniformity of the magnetic field of the concentrated magnetic flux is reduced, and control over the orbit of the beam is difficult.

An object of the invention is to realize a deflection electromagnet device capable of generating a high magnetic field, preventing an increase in size of a vacuum duct and facilitating control over a beam orbit.

Solution to Problem

In order to solve the above problems, a deflection electromagnet device according to the invention is configured as described below.

The deflection electromagnet device includes: a first coil and a second coil which are disposed to face each other with a charged particle beam path interposed therebetween; a first ferromagnetic material disposed on an outer side of the first coil and a second ferromagnetic material disposed on an outer side of the second coil, which face each other with the charged particle beam interposed therebetween; and a magnetic flux induction material, which is partially surrounded by the first coil and the second coil and has at least one superconductor, and through which the charged particle beam path passes, wherein an current induced by a magnetic flux generated by the first coil and the second coil flows in the superconductor in a direction parallel to the charged particle beam path.

Advantageous Effect

A deflection electromagnet device capable of generating a high magnetic field, preventing an increase in size of a vacuum duct and facilitating control over a beam orbit can be realized.

BRIEF DESCRIPTION OF DRAWINGS

FIG. 1 illustrates a schematic overall configuration of a deflection electromagnet device according to Embodiment 1 of the invention.

FIG. 2 illustrates a schematic cross-sectional view of the deflection electromagnet device taken along a vacuum duct.

FIG. 3 illustrates an example of a configuration of a second magnetic flux induction member.

FIG. 4 illustrates an example of a configuration of a first magnetic flux induction member.

FIG. 5 illustrates a schematic cross-sectional view of a deflection electromagnet device taken along a vacuum duct, according to Embodiment 2 of the invention.

FIG. 6 illustrates an example of a configuration of a second magnetic flux induction member according to Embodiment 2.

FIG. 7 illustrates a schematic cross-sectional view of a deflection electromagnet device taken along a vacuum duct, according to Embodiment 3 of the invention.

FIG. 8 illustrates an example of a configuration of a second magnetic flux induction member according to Embodiment 3 of the invention.

FIG. 9 illustrates an example of a configuration of a first magnetic flux induction member according to Embodiment 3 of the invention.

FIG. 10 illustrates an example of a cross-sectional view of a deflection electromagnet device taken along a vacuum duct, according to Embodiment 4 of the invention.

FIG. 11 illustrates a schematic cross-sectional view of a deflection electromagnet device taken along a vacuum duct 25, according to Embodiment 5 of the invention.

DESCRIPTION OF EMBODIMENTS

Hereinafter, embodiments of the invention will be described with reference to the accompanying drawings.

Embodiments

Embodiment 1

FIG. 1 illustrates a schematic overall configuration of a deflection electromagnet device 100 according to Embodiment 1 of the invention. A main configuration of the deflection electromagnet device 100 according to Embodiment 1b will be described below.

In FIG. 1, the deflection electromagnet device 100 includes: connecting members 22*a* (first ferromagnetic material) and 22*b* (second ferromagnetic material) made of a ferromagnetic material, which are fixed to a support member 23, face each other and are disposed at an upper position and a lower position respectively; return poles 20*a* and 21*a*, which are fixed by bolts or the like and are in contact with a lower surface of the connecting member 22*a*; return poles 20 and 21*b*, which are fixed by bolts or the like and are in contact with an upper surface of the connecting member 22*b*; a coil 12*a* (first coil), which is on the lower surface of the connecting member 22*a*, disposed between the return poles 20*a* and 21*a*, and is fixed via a load supporter 11; a fixed coil 12*b* (second coil), which is on the upper surface of the connecting member 22*b* and disposed between the return poles 20*b* and 21*b*; and a vacuum heat insulation container 10, which is supported on the connecting member 22*a* by the load supporter 11, between the coils 12*a* and 12*b*.

The vacuum heat insulation container 10 may be supported on the connecting member 22*b* by a load supporter similar to the load supporter 11.

The coils 12*a* and 12*b* are connected to an excitation power supply 30 via excitation wires 31*a*, 31*b*, and 31*c*. The vacuum heat insulation container 10 is connected to a refrigerant container 40 via refrigerant pipes 41*a* and 41*b*. The vacuum heat insulation container 10 is provided with a through hole along a charged particle beam orbit 24, and a vacuum duct 25 (charged particle beam path) through which a charged particle passes is provided in the through hole.

Next, an example of configurations and a role of each configuration in the vacuum heat insulation container 10 as described above will be described with reference to FIG. 2. FIG. 2 illustrates a schematic cross-sectional view of the deflection electromagnet device 100 taken along the vacuum duct 25.

In FIG. 2, a first magnetic flux induction material 101*a*, a second magnetic flux induction member 101*b*, and a third magnetic flux induction material 102, which are made of superconductors, are fixed in the vacuum heat insulation container 10, as a mechanism for concentrating the magnetic flux generated by the coils 12*a* and 12*b*. The first magnetic flux induction material 101*a* is disposed on a connecting member 22*a* side, and the second magnetic flux induction material 101*b* is disposed on a connecting member 22*b* side. The third magnetic flux induction material 102 is disposed between the material 101*a* and the material 101*b*. The first magnetic flux induction material 101*a* is surrounded by the coil 12*a*, and the second magnetic flux induction material 101*b* is surrounded by the coil 12*b*. The vacuum duct 25 passes through the third magnetic flux induction material 102.

Next, the role of each configuration described above will be described in accordance with an operation procedure of the deflection electromagnet device 100.

A refrigerant is introduced from the refrigerant container 40 through the refrigerant pipe 41*a* into the vacuum heat insulation container 10. At this time, with a sensor (not shown) provided in the vacuum heat insulation container 10, it is evaluated whether the first magnetic flux induction material 101*a*, the second magnetic flux induction material 101*b*, and the third magnetic flux induction material 102 are immersed with the refrigerant.

The excitation power supply 30 is operated to excite the coils 12*a* and 12*b* after the first magnetic flux induction material 101*a*, the second magnetic flux induction material 101*b*, and the third magnetic flux induction material 102 are immersed in the refrigerant.

For example, liquid helium, liquid hydrogen, liquid neon, or liquid nitrogen can be used as the refrigerant, and a refrigerant whose boiling point is equal to or lower than the superconducting transition temperature can be used depending on the type of the superconductor forming the first magnetic flux induction material 101*a*, the second magnetic flux induction material 101*b*, and the third magnetic flux induction material 102.

With respect to the sensor for evaluating whether the first magnetic flux induction material 101*a*, the second magnetic flux induction material 101*b* and the third magnetic flux induction material 102 are immersed in the refrigerant, a known resistance measuring type liquid level meter capable of measuring the liquid level of the refrigerant, or a known resistance thermometer or thermocouple installed on an upper surface of the first magnetic flux induction material 101*a* can be used.

Next, configurations of the magnetic flux induction materials 101*a*, 101*b* and 102 will be illustrated, and a structure for inserting the vacuum duct 25 into the vacuum heat insulation container 10 will be described.

FIG. 4 illustrates an example of a configuration of the second magnetic flux induction material 101*b*. In FIG. 4, the second magnetic flux induction material 101*b* includes a superconductor 26 and a structure-reinforcing member 28 for preventing cracks due to the electromagnetic force of the superconductor 26, and the superconductor 26 and the structure-reinforcing member 28 are bonded by a resin. The superconductor 26 is in an annular shape and has a substantially trapezoidal cross section, and an inner surface of the structure-reinforcing member 28 is in a shape conforming to a shape of an outer surface of the superconductor 26.

The superconductor 26 includes an opening part 50, and a slit 27 in a circumferential direction. Only one slit 27 is shown in FIG. 4, but at least one or more slits may be provided in the circumferential direction. For example, a superconductor such as niobium titanium, niobium tin, magnesium diboride, or a high-temperature superconducting conductor of a copper oxide can be used as the superconductor 26.

For example, a non-magnetic metal such as non-magnetic stainless steel, oxygen-free copper, or an aluminum alloy can be used as the structure-reinforcing member 28. Although not shown, the structure-reinforcing member 28 may be positioned on an opening part 50 side of the superconductor 26.

When the magnetic flux generated by the coils 12*a* and 12*b* shown in FIG. 2 passes through the opening part 50 of the superconductor 26, a shielding current flows on an inner circumferential side of the superconductor 26. As shown in FIG. 4, magnetic flux lines 29 bend toward a center direction of the superconductor 26, and the magnetic flux is concentrated. Having a property of zero electrical resistance, once the shielding current in the superconductor 26 continues to flow, the shielding current flows permanently as long as a normal conduction transition does not occur. Therefore, an effect of bending the magnetic flux lines 29 permanently is obtained even after an excitation current of the coils 12*a* and 12*b* is constant.

The magnetic flux concentrated by the second magnetic flux induction material 101*b* enters an opening part of the third magnetic flux induction material 102. The flow of the magnetic flux will be described with reference to FIG. 3.

FIG. 3 illustrates an example of a configuration of the third magnetic flux induction material 102. In FIG. 3, the magnetic flux induction material 102 includes a high-temperature superconductor 53 having an annular shape or a cylindrical shape. The high-temperature superconductor 53 is discontinuous in the circumferential direction and includes at least one or more slits 54 in the circumferential direction. In the example as shown in FIG. 3, two slits 54 are formed. Although not shown, a structure-reinforcing member dealing with the electromagnetic force can be provided on both an inner diameter side and an outer diameter side of the high-temperature superconductor 53, similar to the second magnetic flux induction material 101*b*.

For example, a high-temperature superconductor having large crystal anisotropy, such as a rare-earth copper oxide superconductor, can be used as the high-temperature superconductor 53.

When a direction parallel to the charged particle beam orbit 24 is taken as ay-axis, a direction vertical to the y-axis and in the same plane with the y-axis is taken as an x-axis, and a direction orthogonal to the y-axis is taken as a z-axis, the high-temperature superconductor 53 is disposed such that a crystal direction c-axis of the high-temperature superconductor 53 and the z-axis are parallel to each other. In other words, the high-temperature superconductor 53 is disposed such that a crystal direction a-b plane of the high-temperature superconductor 53 is parallel to the vacuum duct 25 which is a through hole. The reason is to prevent the magnetic field in an air core part of the high-temperature superconductor 53 in the z-axis direction from being non-uniform.

The reason for the above will be described below.

In FIG. 3, magnetic flux lines 51 from the −z direction to the +z direction are likely to flow out of the through hole formed in the high-temperature superconductor 53 due to the physical property thereof. Therefore, a circulation current 55 tends to flow in parallel to the circumferential direction of the vacuum duct 25 on an inner side surface of the high-temperature superconductor 53 according to the law of electromagnetic induction. Meanwhile, a shielding current 52 shown in FIG. 3 flows inside the high-temperature superconductor 53 in order to prevent the magnetic field in the z-axis direction. Here, in the high-temperature superconductor 53, the crystal anisotropy is large, and a current parallel to an x-y plane is dominant. That is, a current in the z-axis direction decreases, the circulation current 55 decreases, the shielding current 52 in the x-y plane is dominant, and the non-uniformity of the magnetic field in the z direction is prevented.

The opening parts of the first magnetic flux induction material 101*a*, the second magnetic flux induction material 101*b*, and the third magnetic flux induction material 102 are shown in a circular shape, but may be in a shape, a part of which is a straight line, such as a racetrack shape, for example.

Here, the second magnetic flux induction material 101*b* is shown in FIG. 4, and the first magnetic flux induction material 101*a* also has the same shape as that of the second magnetic flux induction material 101*b*. However, the first magnetic flux induction material 101*a* is disposed with across section thereof in an inverted trapezoidal shape in the vacuum heat insulation container 10. Therefore, the magnetic flux lines 29 flow from the small opening part 50 to a large opening part of the superconductor 26 and flow to diffuse the magnetic flux.

In FIG. 2, the magnetic flux lines 51 exiting the third magnetic flux induction material 102 pass through the opening part of the first magnetic flux induction material 101*a*, pass through the connecting member 22*a*, pass through the return poles 20*a* and 21*a*, cross the vacuum duct 25, and then enter the return poles 20*b* and 21*b* respectively and the connecting member 22*b*. That is, the connecting member 22*a*, the return poles 20*a*, 21*a*, 20*b* and 21*b*, and the connecting member 22*b* form a magnetic circuit crossing the vacuum duct 25 which is a charged particle beam path.

A magnetic material such as a steel material or pure iron is used for the return poles 20*a*, 21*a*, 20*b*, and 21*b*, and the connecting members 22*a* and 22*b* in order to form a magnetic circuit. Here, the return poles 20*a* and 21*a*, the connecting member 22*a*, the return poles 20*b* and 21*b*, and the connecting member 22*b* are shown in a divided configuration, and may also be integrated. The return poles 20*a*, 21*a*, 20*b*, and 21*b*, and the connecting members 22*a* and 22*b* may be laminated steel plates.

The magnetic flux lines 51 from the return pole 20*a* pass through the vacuum duct 25 and the traveling direction of the charged particle beam 24 is thus deflected, thereby generating radiation. Further, the magnetic flux lines 51 pass through the vacuum duct 25 disposed on the high-temperature superconductor 53 in the vacuum heat insulation container 10 and the travelling direction of the charged particle beam 24 is thus deflected, thereby generating radiation. Furthermore, the magnetic flux lines 51 from the return pole 21*a* pass through the vacuum duct 25 and the traveling direction of the charged particle beam 24 is thus deflected, thereby generating radiation.

That is, a three-pole magnetic field is formed in a beam orbit direction and the charged particle beam 24 is thus deflected by individual magnetic fields, so that radiation can be generated while the charged particle beam 24 returns to a coaxial orbit. Therefore, an increase in size of the vacuum duct 25 can be prevented.

Further, according to the deflection electromagnet device 100 of Embodiment 1 of the invention, the shielding current 52 is dominant the non-uniformity of the magnetic field in the z-axis direction can be prevented by disposing the high-temperature superconductor 53 having the crystal direction c-axis in a direction orthogonal to a horizontal plane in which the charged particle beam flows. Further, an increase in size of the vacuum duct 25 can be prevented.

That is, according to Embodiment 1 of the invention, it is possible to realize a deflection electromagnet device capable of generating a high magnetic field, preventing an increase in size of the vacuum duct and facilitating control over the beam orbit.

It should be noted that, although the current supplied from the excitation power supply 30 is made to be 0 A after the use of the deflection electromagnet device 100, when the temperature of the magnetic flux induction materials 101*a*, 101*b*, and 102 is equal to or lower than the superconducting transition temperature forming the above materials, the shielding current of the superconductor 26 and the high-temperature superconductor 53 remains, thereby affecting the charged particle beam orbit 24. Therefore, in order to eliminate the shielding current, it is desirable to attach a heater (not shown) to the superconductor 26 and the high-temperature superconductor 53 after the use of the deflection electromagnet device, so as to raise the temperature to a temperature equal to or higher than the superconducting transition temperature.

Further, when an operating temperature of the magnetic flux induction materials 101*a*, 101*b*, and 102 during the use of the deflection electromagnet device 100 is 20 K or lower, a radiation shield can be provided between the vacuum heat insulation container 10 and the magnetic flux induction materials 101*a*, 101*b*, and 102.

Embodiment 2

Next, Embodiment 2 of the invention will be described.

Embodiment 2 is an example of a deflection electromagnet magnet device 200 capable of further reducing an interval of the three-pole magnetic field in the beam orbit direction and further preventing a decrease in uniformity of the magnetic field of the air core part in the magnetic flux induction material.

FIG. 5 illustrates a schematic cross-sectional view of the deflection electromagnet device 200 according to Embodiment 2, taken along the vacuum duct 25.

In the deflection electromagnet device 200 shown in FIG. 5, the reference numerals same as those shown in FIG. 1 to FIG. 4 and already described indicate members having the same functions, and descriptions thereof will be omitted.

In Embodiment 2, return poles 64*a* and 65*a* disposed on the lower surface of the connecting member 22*a* are inclined toward the vacuum heat insulation container 10 at an acute angle with a horizontal plane of the connecting member 22*a*. Return poles 64*b* and 65*b* disposed on the upper surface of the connecting member 22*b* are inclined toward the vacuum heat insulation container 10 at an acute angle with a horizontal plane of the connecting member 22*b*. Magnetic flux lines 56 passing through the return poles 64*b* and 65*b* pass through an air core of a second magnetic flux induction member 202 after passing through the opening part of the first magnetic flux induction material 101*b*.

That is, the first ferromagnetic material 22*a* includes a first return pole 64*a* and a second return pole 65*a*, which extend toward a charged particle beam path 25 and face each other with a first coil 12*a* interposed therebetween. The second ferromagnetic material includes a third return pole 64*b* and a fourth return pole 65*b*, which extend toward the charged particle beam path 25 and face each other with a second coil 12*b* interposed therebetween. An interval between the first return pole 64*a* and the second return pole 65*a* and an interval between the third return pole 64*b* and the fourth return pole 65*b* decrease as the distance from the charged particle beam path 25 decreases.

With the above configuration, the magnetic flux lines 56 generated by exciting the coils 12*a* and 12*b* pass through the return poles 64*a*, 64*b*, 65*a*, and 65*b* at an acute angle, so that an interval of the three-pole magnetic field is narrowed. That is, an interval of the magnetic field, between a portion where the magnetic flux lines from the return pole 64*a* to the return pole 64*b* pass through the vacuum duct 25 and a portion where the magnetic flux lines generated in the air core of the second magnetic flux induction material 202 pass through the vacuum duct 25, is narrowed, and an interval of the magnetic field, between a portion where the magnetic flux lines from the return pole 65*a* to the return pole 65*b* pass through the vacuum duct 25 and the portion where the magnetic flux lines generated in the air core of the second magnetic flux induction material 202 pass through the vacuum duct 25, is narrowed.

FIG. 6 illustrates an example of a configuration of the second magnetic flux induction material 202 according to Embodiment 2. In FIG. 6, the second magnetic flux induction material has a structure in which a plurality of thin superconductors 61 having planes parallel to the x-y plane are laminated, and there are gaps 63 between the thin superconductors 61. Due to the gaps 63, a circulation current cannot flow around a through hole into which the vacuum duct 25 is inserted.

Therefore, it is possible to prevent a decrease in uniformity of the magnetic field of the air core part in the second magnetic flux induction material 202, as compared with Embodiment 1.

In Embodiment 2, since the crystal anisotropy of the superconductor 61 is not used, various superconductors, such as niobium titanium, niobium tin, magnesium diboride, and a thin film of a high-temperature superconducting conductor of a copper oxide can be used as the superconductor 61.

According to Embodiment 2, it is possible to prevent a decrease in uniformity of the magnetic field of the air core part in the second magnetic flux induction material 202 while the interval of the three-pole magnetic field is narrowed, without using the crystal anisotropy of the superconductor. Further, similar to Embodiment 1, an increase in size of the vacuum duct 25 can be prevented.

Embodiment 3

Next, Embodiment 3 of the invention will be described.

Embodiment 3 is an example of a deflection electromagnet magnet device 300 capable of controlling a magnetic flux concentration magnification by controlling a temperature of a magnetic flux induction material, and preventing a decrease in uniformity of the magnetic field of the air core part of the magnetic flux induction material better than that in Embodiment 1.

FIG. 7 illustrates a schematic cross-sectional view of the deflection electromagnet device 300 according to Embodiment 3, taken along the vacuum duct 25.

In the deflection electromagnet device 300 shown in FIG. 7, the reference numerals same as those shown in FIG. 1 to FIG. 4 and already described indicate members having the same functions, and descriptions thereof will be omitted.

In Embodiment 3, a vacuum heat insulation container 303, accommodating a first magnetic flux induction member 301*a*, a second magnetic flux induction member 301*b* and third magnetic flux induction members 302*a* and 302*b*, is connected to a vacuum heat insulation pipe 306. A good heat conductor 304 of the first magnetic flux induction member 301*a* and the third magnetic flux induction member 302*a* passes through the vacuum heat insulation pipe 306, and the good heat conductor 304 is in contact with a refrigerator 305 for freezing the vacuum heat insulation container 303.

A heater 307 of the first magnetic flux induction member 301*a* and the third magnetic flux induction member 302*a* is attached to the refrigerator 305. The heater 307 can also be attached to the good heat conductor 304, the first magnetic flux induction member 301*a* or the third magnetic flux induction member 302*a*.

Although not shown, a known resistance thermometer, thermocouple, or the like is attached to the first magnetic flux induction member 301*a* and the third magnetic flux induction member 302*a*, and based on temperature measurement results thereof, a feedback control is performed on the output of the heater 307, so that the first magnetic flux induction member 301*a* and the third magnetic flux induction member 302*a* can be set to have any temperature.

Further, the vacuum heat insulation container 303 accommodates the second magnetic flux induction member 301*b* and the third magnetic flux induction member 302*b*, and is connected to a vacuum heat insulation pipe 306A. Similar to the vacuum heat insulation pipe 306, a good heat conductor of the second magnetic flux induction member 301*b* and the third magnetic flux induction member 302*b* passes through the vacuum heat insulation pipe 306A, and the good heat conductor is in contact with a refrigerator in the vacuum heat insulation pipe 306A.

Further, a heater of the second magnetic flux induction member 301*b* and the third magnetic flux induction member 302*b* is attached to the refrigerator.

The first magnetic flux induction member 301*a* and the second magnetic flux induction member 301*b* have the same configuration as the first magnetic flux induction member 101*a* and the second magnetic flux induction member 101*b* of Embodiment 1.

A current density of a shielding current flowing in the superconductor changes with the temperature. Therefore, by controlling the temperature, it is possible to change the shielding current and thus to control the concentration magnification of the magnetic flux. As a result, the measurement target can be enlarged with the radiation having arbitrary energy.

The refrigerator 305 is a known refrigerator, for example, a Ginzburg-McMahon refrigerator (hereinafter, referred to as a GM refrigerator), a Stirling refrigerator, and a pulse tube refrigerator.

FIG. 8 illustrates exemplary configurations of the third magnetic flux guide members 302*a* and 302*b* of Embodiment 3.

In FIG. 8, the third magnetic flux induction member 302*a* is formed of a superconductor 71*a* including a slit 54, and the third magnetic flux induction member 302*b* is formed of a superconductor 71*b* including another slit 54. Further, the third magnetic flux induction members 302*a* and 302*b* are in contact with the good heat conductor 304, and are cooled by the refrigerator 305.

In Embodiment 3, the third magnetic flux induction member is divided into 302*a* and 302*b*, and the vacuum duct 25 is disposed between the third magnetic flux induction members 302*a* and 302*b*. The third magnetic flux induction members 302*a* and 302*b* are not arranged in an x-y plane direction of the vacuum duct 25. In Embodiment 3, since the concentrated magnetic flux flows out of a gap between the third magnetic flux induction members 302*a* and 302*b*, the magnetic field applied to the charged particle beam is lower as compared with those of Embodiment 1 and Embodiment 2. However, the non-uniformity of the magnetic field can be prevented as compared with Embodiment 1 since the circulation current is not generated around the vacuum duct 25.

FIG. 9 illustrates an exemplary configuration of the second magnetic flux induction member 301*b* of Embodiment 3. In FIG. 9, the second magnetic flux induction member 301*b* has a trapezoidal cross section, and has a configuration in which a good heat conductor 308 is bonded to an inner diameter side of a superconductor 309 including a slit 27. The good heat conductor 308 can also be used as a structure-reinforcing member in an inner diameter direction of the second magnetic flux induction member 301*b*. Further, the structure-reinforcing member 28 may be a good heat conductor such as oxygen-free copper.

The first magnetic flux induction member 301*a* also has a configuration same as that of the second magnetic flux induction member 301*b*, but is disposed to have an inverted trapezoidal cross section as shown in FIG. 7.

As described above, according to Embodiment 3 of the invention, in the deflection electromagnet device 300, the magnetic flux concentration magnification can be controlled, and decrease in uniformity of the magnetic field of the air core part in the magnetic flux induction member can be further prevented as compared with Embodiment 1, in addition to obtaining the effects same as in Embodiment 1.

Embodiment 4

Next, Embodiment 4 of the invention will be described.

Embodiment 4 is an example of a deflection electromagnet device 400 capable of generating a more small-sized and high magnetic field.

FIG. 10 illustrates an example of a cross-sectional view of the deflection electromagnet device 400 according to Embodiment 4, taken along the vacuum duct 25.

In the deflection electromagnet device 400 of FIG. 10, the reference numerals same as those shown in FIG. 1 to FIG. 4 and already described indicate members having the same functions, and descriptions thereof will be omitted.

In Embodiment 4, coils 402*a* and 402*b*, first magnetic flux induction members 101*a* and 101*b*, and the third magnetic flux induction member 102 are accommodated in a vacuum heat insulation container 403.

By immersing the coils 402*a* and 402*b* in a refrigerant of the vacuum heat insulation container 403, a larger current can flow as compared with a case of using both of a normal conductive coil, such as a copper wire, and a superconducting coil.

Since a superconducting wire can carry a current having a density 100 times or more of that of a current which can be carried by a copper wire, the cross-sectional area of the superconducting wire can be reduced correspondingly, and thereby the size of the coils 402*a* and 402*b* can be reduced.

According to the configuration described above, a deflection electromagnet device capable of generating a more small-sized and high magnetic field can be realized in Embodiment 4, in addition to obtaining the effects same as in Embodiment 1.

embodiment 5

Next, Embodiment 5 of the invention will be described.

Embodiment 5 is an example of a deflection electromagnet device 500 whose beam orbit direction is smaller than that in Embodiment 4.

FIG. 11 is a schematic cross-sectional view of the deflection electromagnet device 500 according to Embodiment 5, taken along the vacuum duct 25.

In the deflection electromagnet device 500 shown in FIG. 11, the reference numerals same as those shown in FIG. 1 to FIG. 4 and FIG. 10 and already described indicate members having the same functions, and descriptions thereof will be omitted.

In Embodiment 5, a vacuum heat insulation container 505 is disposed in a gap space between return poles 72*a* and 72*b* for magnetic flux lines passing therethrough, and fourth magnetic flux induction members 501*a*, 501*b*, and 502 are accommodated in the vacuum heat insulation container 505.

Similar to the first magnetic flux induction member 101*a* and the first magnetic flux induction member 101*b*, the fourth magnetic flux induction members 501*a* and 501*b* include at least one or more slits in the circumferential direction, and the area of the opening part decreases as the area increases from the return poles 72*a* and 72*b* to the vacuum duct 25.

In FIG. 11, opening part inner diameter sides of the coils 402*a* and 402*b*, close to the fourth magnetic flux induction members 501*a* and 501*b*, are in linear shapes, and can be closer to the magnetic flux in the air core of the third magnetic flux induction member 102.

Similar to the third magnetic flux induction member 102, the fourth magnetic flux induction member 502 is disposed such that an crystal a-b plane of the high-temperature superconductor is parallel (crystal direction c axis and z axis are in parallel) to the orbit direction of the charged particle beam, and the vacuum duct 25 is inserted into the through hole.

A vacuum heat insulation container 507 is disposed in a gap space between return poles 73*a* and 73*b* for magnetic flux lines passing therethrough, and fifth magnetic flux induction members 506*a*, 506*b*, and 503 are accommodated in the vacuum heat insulation container 507.

Similar to the first magnetic flux induction member 101*a* and the second magnetic flux induction member 101*b*, the fifth magnetic flux induction members 506*a* and 506*b* include at least one or more slits in the circumferential direction, and the area of the opening part decreases as the area increases from the return poles 73*a* and 73*b* to the vacuum duct 25.

Opening part inner diameter sides of the coils 402*a* and 402*b*, close to the fifth magnetic flux induction members 506*a* and 506*b*, are in linear shapes, and can be closer to the magnetic flux in the air core of the third magnetic flux induction member 102.

Similar to the third magnetic flux induction member 102, the fifth magnetic flux induction member 503 is disposed such that the crystal a-b plane of the high-temperature superconductor is parallel (crystal direction c axis and z axis are in parallel) to the orbit direction of the charged particle beam, and the vacuum duct 25 is inserted into the through hole.

The refrigerant in the refrigerant container 40 is supplied to the vacuum heat insulation container 403 via the refrigerant pipes 41*a* and 41*b*, and is supplied to the vacuum heat insulation container 505 via refrigerant pipes 504*a* and 504*b*. The refrigerant in the refrigerant container 40 is supplied to the vacuum heat insulation container 507 via refrigerant pipes 508*a* and 508*b*.

The magnetic flux induction members 501*a*, 501*b*, 506*a*, and 506*b* made of a superconductor can concentrate the magnetic flux in the air core even at a saturation magnetization of 2.2 T or more of a ferromagnetic material such as iron, and can have a good effect with a higher magnetic field.

With the configuration described above, in the deflection electromagnet device 500, the beam orbit direction is smaller and a high magnetic field can be generated.

In Embodiment 5, a higher magnetic field can also be obtained as described above, in addition to obtaining the effects same as in Embodiment 1.

All the magnetic flux induction members are cooled by the refrigerant in Embodiments 1 to 5, and a temperature control mechanism may also be provided in the magnetic flux induction members in Embodiments 1 to 2 and 4 to 5, as in Embodiment 3.

In the embodiments described above, the first magnetic flux induction members 101*a* and 301*a*, the second magnetic flux induction members 101*b* and 301*b*, and the third magnetic flux induction members 102, 202, 302*a*, and 302*b* have a structure having a superconductor, and may have a structure without a superconductor.

REFERENCE SIGN LIST

10, 303, 403, 505, 507 vacuum heat insulation container
11 load supporter
12*a*, 12*b*, 402*a*, 402*b* coil
20*a*, 20*b*, 21*a*, 21*b*, 64*a*, 64*b*, 65*a*, 65*b*, 72*a*, 72*b*, 73*a*, 73*b* return pole
22*a*, 22*b* connecting member
23 support member
24 charged particle beam orbit
25 vacuum duct
26, 61, 71*a*, 71*b*, 309 superconductor
27, 54 slit
28 structure-reinforcing member
29, 51, 56 magnetic flux line
30 excitation power supply
31*a*, 31*b*, 31*c* excitation wire
40 refrigerant container
41*a*, 41*b*, 504*a*, 504*b*, 508*a*, 508*b* refrigerant pipe
50 opening part
52, 62 shielding current
53 high-temperature superconductor
55 circulation current
63 gap
100, 200, 300, 400, 500 deflection electromagnet device
101*a*, 301*a* first magnetic flux induction member
101*b*, 301*b* second magnetic flux induction member
102, 202, 302*a*, 302*b* third magnetic flux induction member
304, 308 good heat conductor
305 refrigerator
306, 306A, 505, 507 vacuum heat insulation pipe
307 heater
501*a*, 501*b*, 502 fourth magnetic flux induction member
502, 506*a*, 506*b*, 503 fifth magnetic flux induction member

The invention claimed is:

1. A deflection electromagnet device, comprising:

a first coil and a second coil which are disposed to face each other with a charged particle beam path interposed therebetween;

a first ferromagnetic material disposed on an outer side of the first coil and a second ferromagnetic material disposed on an outer side of the second coil, which face each other with the charged particle beam interposed therebetween; and a magnetic flux induction material, which is partially surrounded by the first coil and the second coil and includes at least one superconductor, and through which the charged particle beam path passes, wherein an current induced by a magnetic flux generated by the first coil and the second coil flows in the superconductor in a direction parallel to the charged particle beam path.

2. The deflection electromagnet device according to claim 1, wherein the first ferromagnetic material, the second ferromagnetic material and the magnetic flux induction member form a magnetic circuit in which the magnetic flux generated by the first coil and the second coil crosses the charged particle beam path.

3. The deflection electromagnet device according to claim 1, wherein a through hole, through which the charged particle beam path passes, is formed in the superconductor and is parallel to a crystal direction a-b plane of the superconductor, and the superconductor has crystal anisotropy.

4. The deflection electromagnet device according to claim 1, wherein the magnetic flux induction member includes a plurality of superconductors, and gaps are formed between the plurality of superconductors.

5. The deflection electromagnet device according to claim 1, wherein the magnetic flux induction member includes a plurality of superconductors, gap are formed between the plurality of superconductors, and the charged particle beam path is formed in the gaps.

6. The deflection electromagnet device according claim 1, further comprising:

a heat insulation container which accommodates the superconductor; and a refrigerator which refrigerates the heat insulation container.

7. The deflection electromagnet device according to claim 6, wherein the heat insulation container is supported by the first ferromagnetic material or the second ferromagnetic material.

8. The deflection electromagnet device according to claim 6, further comprising:

a temperature control mechanism which is disposed in the heat insulation container and is configured to control a temperature of the superconductor.

9. The deflection electromagnet device according to claim 1, wherein the first ferromagnetic material includes a first return pole and a second return pole, which extend toward the charged particle beam path and face each other with the first coil interposed therebetween; the second ferromagnetic material includes a third return pole and a fourth return pole, which extend toward the charged particle beam path and face each other with the second coil interposed therebetween; and an interval between the first return pole and the second return pole and an interval between the third return pole and the fourth return pole decrease as a distance from the charged particle beam path decreases.

10. The deflection electromagnet device according to claim 1, wherein the magnetic flux induction member includes a first magnetic flux induction member which is surrounded by the first coil, a second magnetic flux induction member which is surrounded by the second coil, and a third magnetic flux induction member through which the charged particle beam path passes, and the first magnetic flux induction member and the second magnetic flux induction member include an opening part which increases in size as the distance from the charged particle beam path increases.

11. The deflection electromagnet device according to claim 1, wherein the superconductor is in an annular shape and includes a hollow part which allows the magnetic flux generated by the first coil and the second coil to pass, and at least one discontinuous part is formed in a circumferential direction of the superconductor in an annular shape.

12. The deflection electromagnet device according to claim 1, wherein the superconductor is bonded to a structure-reinforcing member.

13. The deflection electromagnet device according to claim 1, further comprising:

a heat insulation container which accommodates the first coil, the second coil and the magnetic flux induction member.

14. The deflection electromagnet device according to claim 13, further comprising:

a fourth magnetic flux induction member and a fifth magnetic flux induction member, which are disposed on outer sides of the first coil and the second coil and have at least one superconductor, and through which the charged particle beam path passes.

* * * * *